US006644498B1

(12) United States Patent
Lemberger et al.

(10) Patent No.: US 6,644,498 B1
(45) Date of Patent: Nov. 11, 2003

(54) CONTINUOUS ROLL PAPER NAPKIN RINGS

(76) Inventors: Mark S. Lemberger, 13515 Dunwoody Dr., Elm Grove, WI (US) 53122; Conrad Canter, 5244 Gilbert Cir., West Bend, WI (US) 53095

( * ) Notice: Subject to any disclaimer, the term of this patent is extended or adjusted under 35 U.S.C. 154(b) by 56 days.

(21) Appl. No.: 10/098,717

(22) Filed: Mar. 15, 2002

Related U.S. Application Data

(60) Provisional application No. 60/276,235, filed on Mar. 15, 2001.

(51) Int. Cl.[7] ..... B65H 1/00

(52) U.S. Cl. ..... 221/33; 221/45

(58) Field of Search ..... 221/33, 34, 45, 221/119, 259, 277, 289; 225/106

(56) References Cited

U.S. PATENT DOCUMENTS

2003/0036039 A1 * 2/2003 Parker ..... 434/156

* cited by examiner

*Primary Examiner*—Kenneth W. Noland
(74) *Attorney, Agent, or Firm*—Andrus, Sceales, Starke & Sawall, LLP

(57) ABSTRACT

A continuous strip of individual napkin ring blanks that can be separated to form a plurality of napkin rings. Each individual ring blank extends between a leading edge and a trailing edge and includes a first adhesive area and a second adhesive area. A line of perforation is formed between the leading edge of one ring blank and the trailing edge of the preceding ring blank such that the ring blanks can be separated from each other. Each of the ring blanks includes a pair of angled locating surfaces formed near its leading edge and a pair of angled locating surfaces formed near its trailing edge to provide a visual indication of the line of perforation between the ring blanks.

5 Claims, 2 Drawing Sheets

CONTINUOUS ROLL PAPER NAPKIN RINGS

The present invention is based on and claims priority to U.S. Provisional Patent Application Serial No. 60/276,235 filed on Mar. 15, 2001 the disclosure of which is incorporated herein by reference.

BACKGROUND OF THE INVENTION

The present invention generally relates to paper napkin rings. More specifically, the present invention relates to a continuous roll of paper napkin rings in which each of the individual rings includes an adhesive area on both its front and back surfaces such that the napkin rings can be sequentially removed from the roll and used in securing a napkin around a set of silverware.

Currently, paper napkin rings are widely used to hold a paper or cloth napkin around a set of eating utensils. Individual paper napkin rings are typically supplied pre-cut into their individual size and stacked one on top of another into a brick of product.

When the ring is to be installed on a napkin surrounding a set of silverware, the napkin ring must be peeled from the stack and formed in its ring shape around the silverware and napkin. Thus, a server must use both hands to peel the paper napkin ring from the stack.

Therefore, a need exists for a new type of napkin ring configuration such that the napkin rings can be sequentially removed from a continuous strip to eliminate the difficulty in removing a napkin ring from the supply stack.

SUMMARY OF THE INVENTION

The present invention is a continuous strip of ring blanks that can be torn from the continuous strip and formed into napkin rings. The supply of napkin rings of the present invention includes a plurality of individual ring blanks each extending between a leading edge and a trailing edge. The ring blanks are joined to each other such that the trailing edge of one ring blank is joined to the leading edge of the following ring blank.

Each of the individual ring blanks includes a front face surface and a back face surface. Preferably, a first adhesive area is formed on the back face surface of each ring blank adjacent to the leading edge of the ring blank. A second adhesive area is formed on the back face surface of each ring blank adjacent to the trailing edge.

In accordance with the invention, a line of perforation is formed between the leading edge of one ring blank and the trailing edge of the following ring blank such that the ring blanks can be separated from each other along the lines of perforation. After the ring blanks have been separated, the first adhesive area of each ring blank can be brought into contact with the second adhesive area to form the ring shape around a napkin and a set of silverware.

In another aspect of the invention, each ring blank includes a pair of angled locating surfaces formed along both the leading edge and the trailing edge. The angled locating surface extends into the ring blank from the side edges such that the line of perforation between successive ring blanks can be located when the ring blanks are connected as a continuous strip.

In another aspect of the present invention, the continuous strip of napkin rings is formed as a roll. The roll of napkin rings is contained within a dispensing container having an outlet opening through which the continuous strip of ring blanks can pass. As a ring blank is separated from the continuous strip, the roll of strips is advanced and the next ring blank can be separated. Preferably, the dispensing container includes a strap for securing the strip along the exterior of the container.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
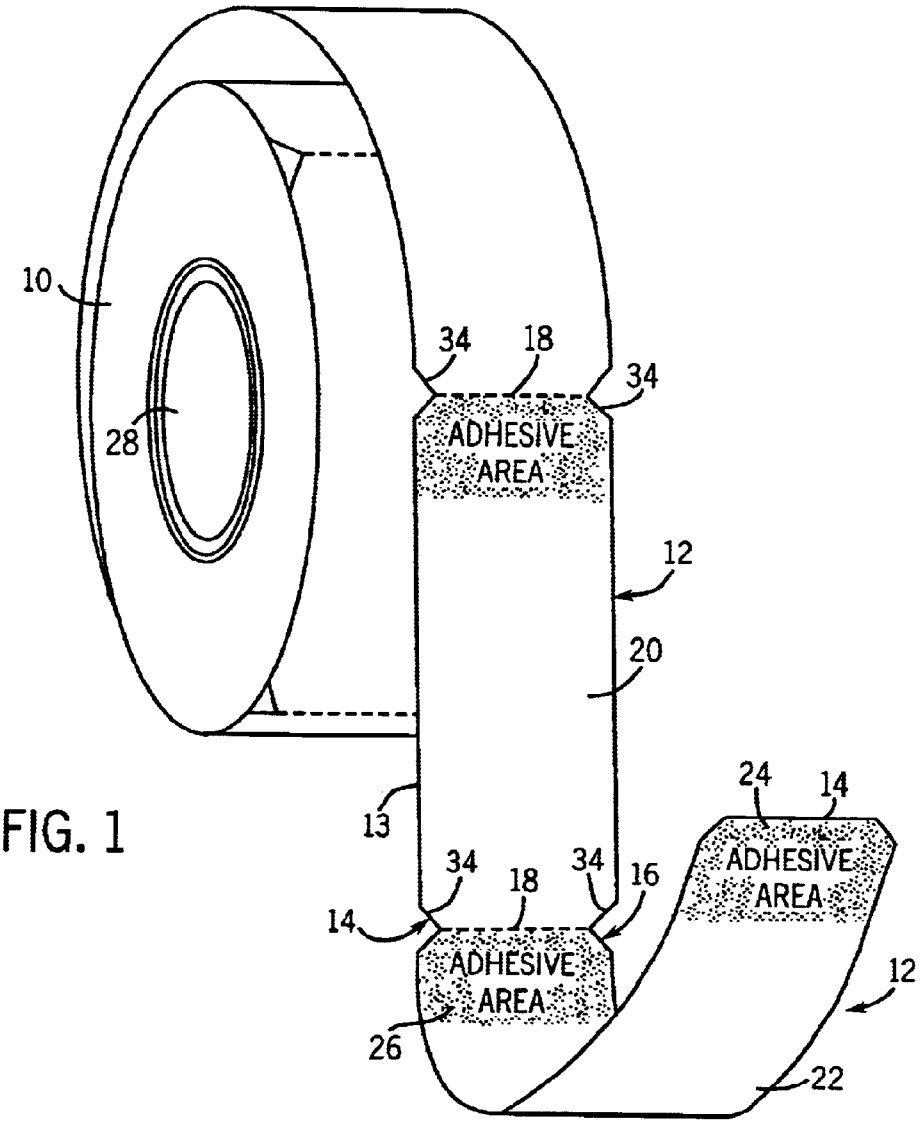
FIG. 1 is a perspective view illustrating the continuous roll of paper napkin rings in accordance with the present invention.

Referring first to FIG. 1, thereshown is a continuous roll 10 of sequentially connected paper napkin rings 12. As illustrated, each of the paper napkin rings 12 is formed from a ring blank 13 that extends between a leading edge 14 and a trailing edge 16. As illustrated in FIG. 1, the leading edge 14 of each ring blank 13 is joined to the trailing edge 16 of the preceding ring blank 13 by a line of perforation 18. The line of perforation 18 allows the continuous roll of ring blanks 13 to be separated into a plurality of individual napkin rings for use in a conventional manner.

Figure 4:
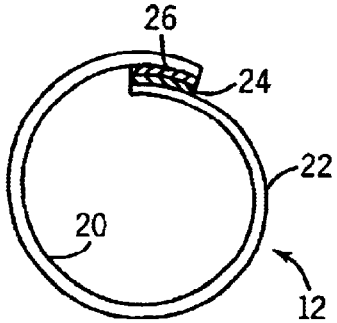
FIG. 4 is a top view illustrating the napkin ring secured in its ring shaped condition, such as used to secure a napkin to set of silverware.

Referring back to FIG. 1, each of the ring blanks 13 includes a front face surface 20 and a back face surface 22. In use, the paper napkin ring 12 is rolled around a set of silverware and used to secure a napkin to the silverware, as shown in FIG. 4.

Each of the ring blanks 13 includes a first adhesive area 24 and a second adhesive area 26. The first adhesive area 24 is formed near the leading edge 14 of the ring blank 13 on the back face surface 22 of the ring blank 13. The second adhesive area 26 is formed near the trailing edge 16 and is contained on the front face surface 20 of the ring blank 13. Thus, when the ring blank 13 is manipulated to form a ring, as shown in FIG. 4, the first adhesive area 24 and the second adhesive area 26 contact each other to secure the paper napkin ring 12 in its ring-like shape.

As illustrated in FIG. 1, the continuous roll 10 includes a central opening 28 that allows the roll 10 to be mounted for rotation about a center axis. In this manner, the roll 10 can be used to distribute the plurality of sequentially joined napkin rings 12.

Figure 3:
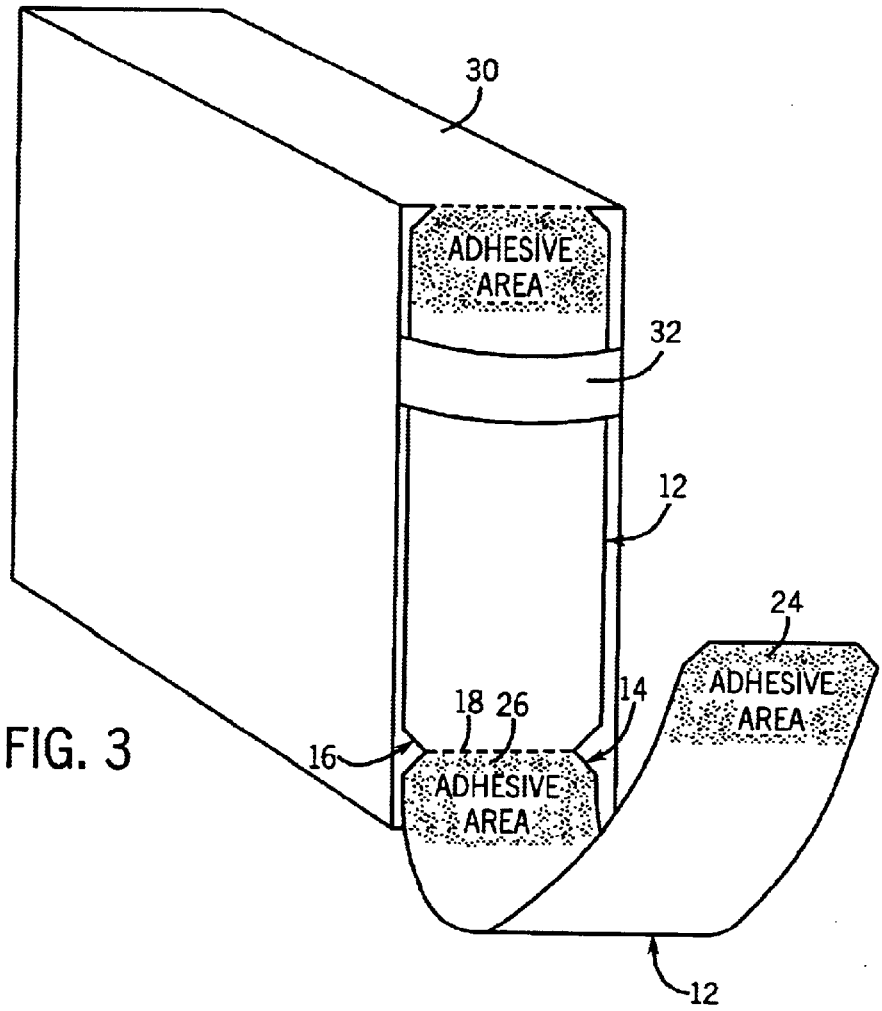
FIG. 3 is a perspective view of an enclosure that includes the roll of paper napkin rings such that the roll can be discharged and each individual napkin ring used to secure a napkin to a set of silverware.

Referring now to FIG. 3, the continuous roll 10 is positioned within an enclosure 30 such that the napkin rings can be dispensed from within the enclosure 30. The enclosure 30 is slightly larger than the roll 10 such that the roll 10 can rotate within the enclosure 30. In the preferred embodiment of the invention, the enclosure 30 includes an outlet and a strap 32 that holds one of the napkin rings 12 in place while the preceding napkin ring is torn from the continuous strip of napkin rings. In this manner, the strap 32 is used to secure the next napkin ring to be removed from the continuous strip. In this manner, the continuous strip of napkin rings 12 can be sequentially distributed and used to hold a napkin in place around a set of silverware.

Figure 2:
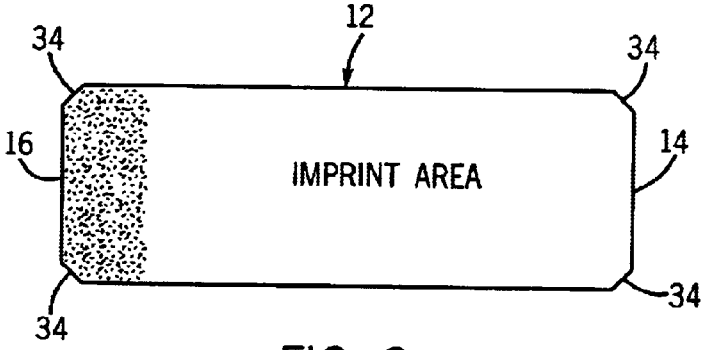
FIG. 2 is a front view illustrating the ring blank and the position of the first adhesive area on the ring blank.

As illustrated in FIGS. 1 and 2, each of the ring blanks 13 includes an angled die cut 34 formed on each side of the ring blank 13 near both the leading edge 14 and the trailing edge 16. As best seen in FIG. 1, the angled die cuts 34 aid in locating the line of perforation 18 between successive ring blanks 13. Thus, the die cut 34 allows the user to more quickly identify where the continuous strip needs to be torn to separate one napkin ring from the continuous strip.

In the preferred embodiment of the invention, each of the ring blanks 13 is formed from paper stock. However, it is contemplated by the inventors that the ring blanks could be formed from other materials, such as a lightweight, flexible plastic or other material. However, it is important that the individual ring blanks 13 can be separated from each other along the lines of perforation 18 as needed.

In accordance with the present invention, the adhesive area positioned on both the front and back surface of the napkin ring is a conventional adhesive as is currently used in the industry. The adhesive area must be strong enough to hold the napkin ring in place around a set of silverware and napkin.

Various alternatives and embodiments are contemplated as being within the scope of the following claims particularly pointing out and distinctly claiming the subject matter regarded as the invention.

We claim:

1. A supply of napkin rings, comprising:

a plurality of individual ring blanks each extending between a leading edge and a trailing edge and having a front face surface and a back face surface, the plurality of ring blanks being joined to each other to define a continuous strip;

a line of perforation formed between the leading edge of one ring blank and the trailing edge of the preceding ring blank, wherein the ring blanks are separable from each other along the lines of perforation;

a first adhesive area formed on the back face surface of each ring blank adjacent the leading edge; and a second adhesive area formed on the front face surface of each ring blank adjacent the trailing edge, wherein the first adhesive area is brought into contact with the second adhesive area to form a napkin ring.

2. The supply of napkin rings of claim 1 wherein each ring blank includes a pair of side surfaces, each ring blank further including a first pair of angled locating surfaces extending between the side surfaces and the leading edge and a second pair of angled locating surfaces extending between the side surfaces and the trailing edge, the angled locating surfaces providing a visual identification of the line of perforation between successive ring blanks.

3. The supply of napkin rings of claim 2 wherein the continuous strip of napkin rings is formed as a roll.

4. The supply of napkin rings of claim 3 further comprising a dispensing container sized to surround the roll, the dispensing container having an outlet opening through which the continuous strip of napkin rings can pass.

5. The supply of napkin rings of claim 4 wherein the dispensing container includes a strap for securing the strip of ring blanks along the exterior of the container.

* * * * *